United States Patent [19]

Lonseth et al.

[11] 4,318,031

[45] Mar. 2, 1982

[54] LAMP, BALLAST AND STARTER VISUAL MONITOR

[75] Inventors: Wayne F. Lonseth, Austin; William C. Dirk-Hazen, Kyle, both of Tex.

[73] Assignee: Esquire, Inc., New York, N.Y.

[21] Appl. No.: 89,852

[22] Filed: Oct. 31, 1979

[51] Int. Cl.[3] ..... H05B 41/18

[52] U.S. Cl. ..... 315/133; 315/135; 315/290; 340/653

[58] Field of Search ..... 315/119, 120, 129, 133, 315/135, 136, 183, 290, 324; 362/20; 340/641, 642, 653, 659

[56] References Cited

U.S. PATENT DOCUMENTS 3,246,201 4/1966 Michalski ..... 315/136 X
3,890,534 6/1975 Horowitz ..... 315/136 X
4,209,730 6/1980 Pasik ..... 315/290
4,236,100 11/1980 Nuver ..... 315/136 X

*Primary Examiner*—Eugene R. La Roche
*Attorney, Agent, or Firm*—Vaden, Eickenroht, Thompson, Bednar & Jamison

[57] ABSTRACT

A visual monitor including a single light indicator for HID lamps (not needing a starter) and a visual monitor including two light indicators for an HID lamp, such as a high pressure sodium lamp, operating in conjunction with the starter. When the lamp is out, the presence or non-presence of an ignited first light indicator indicates lamp failure or ballast failure, respectively. The blinking or nonblinking of the second light indicator indicates whether or not the starter is producing satisfactory starting pulses.

6 Claims, 2 Drawing Figures

LAMP, BALLAST AND STARTER VISUAL MONITOR

BACKGROUND OF THE INVENTION

1. Field of the Invention

This invention relates to maintenance of high intensity, gaseous discharge (HID) lamps and more particularly to visually monitoring the component operating parts of an HID lamp circuit by observing the condition of monitor light indicators.

2. Description of the Prior Art

High intensity, gaseous discharge lamps are frequently installed in high locations, such as at the top of light poles overlooking a parking lot, athletic field or the like, or in locations such as in or suspended from the ceiling of indoor tennis courts, basketball arenas and the like. The replacement of lamps, ballasts and starters when an extinguished lamp is observed is somewhat tedious. Normally, the lamp bulb itself is replaced first. If this does not remedy the cause of lamp outage, the ballast is replaced. For HID lamps requiring a starter, the starter is normally replaced before the ballast. However, such trial and error replacement of parts either require multiple trips to a difficult location or require taking unnecessary parts to a high and difficult location.

Therefore, it is a feature of the present invention to provide an improved visual monitor connected to an HID circuit for indicating which of the component parts of a typical circuit has failed when a monitored lamp is extinguished, such visual monitor being readily observable from a ground location.

SUMMARY OF THE INVENTION

The present invention employs at least a first indicator light in all applications of use. The circuit in which the indicator is connected is connected in position across the HID lamp such that when the lamp opens, which is how such lamp fails, there is an increased current through the indicator light circuit, thereby causing the light to become lit. When there is a ballast failure, insufficient voltage is applied to the lamp and to the indicator light so that the indicator light does not come on. Therefore, by observing that the lamp is out and the indicator light is not on, the maintenance person knows to replace a defective ballast.

High pressure sodium and other HID lamps which require a starter are monitored by a visual monitor circuit including two lights. One light is connected in similar fashion to the light for other HID lamps. The second indicator light is connected in conjunction with a diode and preferably in conjunction with a voltage divider circuit connected to receive pulses from the starter. Each normal pulse from the starter causes the diode to conduct for a short period of time and to store a small charge on a capacitor. When there is a sufficient charge on the capacitor, the second indicator light discharges the capacitor and causes a visual blinking effect. Typically, the relationship of the charging pulses with respect to a discharge occurrence is about 30 to 1. Therefore, for a typical 60 Hz line operation, such a second indicator would blink about twice a second. If the lamp were out and this second indicator light was not blinking, this would be a visual indication that the starter was not supplying proper starting pulses to the lamp and therefore needed replacement.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is noted, however, that the appended drawings illustrate only typical embodiments of the invention and are therefore not to be considered limiting of its scope, for the invention may admit to other equally effective embodiments. In the Drawings.

DESCRIPTION OF THE PREFERRED EMBODIMENTS

Figure 1:
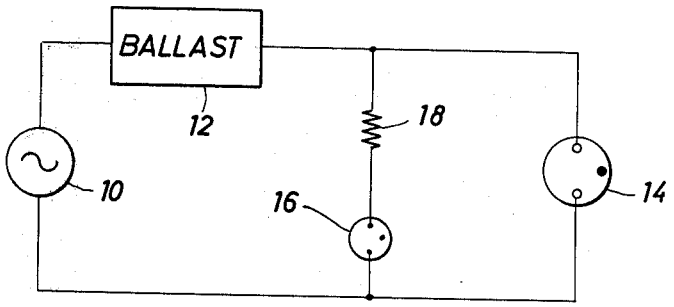
FIG. 1 is a simplified schematic diagram of a visual monitor in accordance with a first embodiment of the present invention operating in conjunction with an HID lamp and, therefore, not requiring a starter.

Now referring to the drawings, and first to FIG. 1, a simplified schematic diagram is shown wherein a visual monitor in accordance with the present invention is connected for operation to a mercury vapor lamp or a metal halide lamp or other typical HID lamp. Source 10, which is typically 60 Hz line voltage, is connected to ballast 12 and to HID lamp 14, which is being monitored.

An indicator light circuit comprising the series combination of indicator light 16 and resistor 18 is connected in parallel with lamp 14.

In normal operation of lamp 14, once lamp 14 is operating, the primary path for current as between the two parallel legs is through lamp 14. However, should lamp 14 fail, an open conduction path exists between the terminals of lamp 14, thereby increasing the current in the circuit through resistor 18 and indicator light 16. Indicator light 16 is typically a neon bulb or other gaseous filled lamp. The increased current causes indicator light 16 to ignite and thereby provides a visual indication to an observer that not only has the lamp failed because it is no longer lit, but that lamp failure is due to an open condition of the lamp because indicator light 16 is now ignited.

The other common cause for failure of the circuit shown in FIG. 1 is a failure of ballast 12. When ballast 12 fails, it does not provide sufficient voltage to maintain power for lighting lamp 14 and therefore lamp 14 extinguishes. However, since no current or only a small amount of current is flowing on the lamp side of the ballast, there is insufficient current through the indicator leg comprising resistor 18 and indicator light 16 to cause indicator light 16 to light. Now, the observer knows that lamp 14 is out, but because of the failure or absence of light from indicator light 16, he also knows that the ballast has failed.

Figure 2:
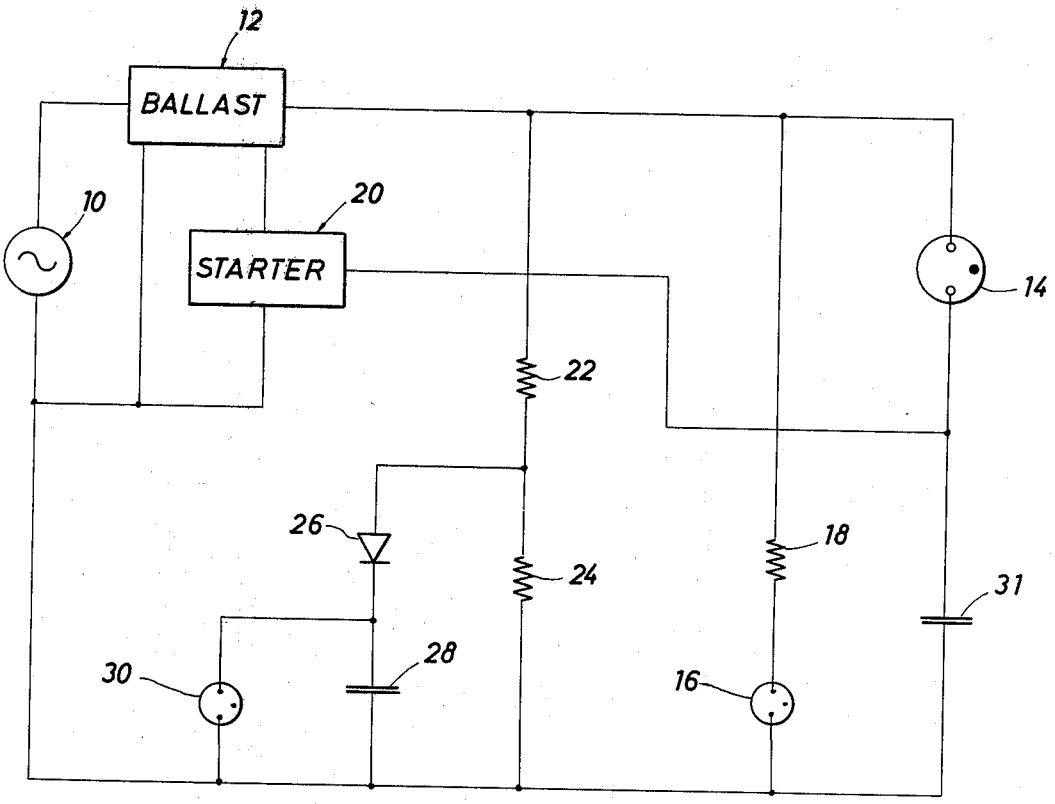
FIG. 2 is a simplified schematic diagram of a second embodiment of the present invention operating in conjunction with an HID lamp, such as a high pressure sodium lamp, which circuit includes a starter.

Now referring to FIG. 2, the connections of a suitable visual monitor circuit connected to a high pressure sodium (HPS) lamp is shown. Such a lamp requires pulsing from a high voltage source in order to ignite the lamp.

The monitor circuit in this case comprises source 10, ballast 12 and lamp 14, all in series with a capacitor 31. Capacitor 31 is provided to provide lead type ballasting for lamp 14.

As in the FIG. 1 circuit, indicator light 16 in series with resistor 18 is connected across lamp 14 and capacitor 31.

In addition, starter 20 is connected to the source and to the ballast and to the junction between lamp 14 and capacitor 31. A voltage divider comprising resistors 22 and 24 is connected to the output of the ballast. A diode 26 is connected to the divider point of the voltage divider and to a capacitor 28. Indicator light 30 is connected across capacitor 28. Indicator light 30 is the same type of lamp that is used for light 16.

In operation, and as in FIG. 1, following normal operation, lamp 14 may go out, leaving in doubt what component of the normal circuit has failed. Should failure be due to an open in lamp 14, an increased current will flow through the leg of the circuit comprising resistor 18 and indicator light 16, thereby causing indicator light 16 to light. Again, as with the circuit in FIG. 1, a failure of ballast 12 to produce sufficient voltage to sustain operation of lamp 14 will also establish insufficient current through resistor 18 and indicator light 16 to cause indicator light 16 to light.

However, there is one other source of potential failure in the circuit of FIG. 2 which is not included in the circuit of FIG. 1. This is starter 20, which produces periodic high peak voltage pulses to ignite lamp 14 when lamp 14 is off under normal operating conditions. The operating condition of starter 20 is monitored by indicator light 30. Under normal conditions when lamp 14 is out, starter 20 produces satisfactorily large starter pulses to lamp 14, which are momentarily stored on 31 and produces pulses through the lamp. These pulses are divided by the voltage divider comprising resistor 22 and resistor 24, thereby providing divided pulses to the anode of diode 26. When the starter pulses are satisfactorily large, the applied pulses to diode 26 are just large enough to cause short periods of conduction of the diode and some small storage on capacitor 28. If a pulse occurs each time there is a cycle of line current, normally 60 times a second, it typically takes the combined efforts of storing thirty pulses on capacitor 28 to be a sufficiently large charge to discharge through indicator light 30. Therefore, about twice a second, indicator 30 will blink as it discharges capacitor 28, indicating that the starter is properly operating. Therefore, if indicator 30 is blinking, and lamp 14 is out, the problem is not in the starter. That is, the starter is applying sufficiently large starting pulses through the lamp in attempting to have the lamp light or relight. However, if indicator 30 is not blinking and the lamp is out, then the starter is not applying sufficient starting pulses to the lamp. If the starter is operating satisfactorily, and lamp 14 is not lit, then the presence or non-presence of a lit indicator 16 indicates whether the problem is in the lamp or in the ballast, all as previously described. In practice, a given installation of HID lamps, HPS or otherwise, would include multiple lamps. The circuits which have been described above are sufficiently inexpensive that each lamp may carry its own visual monitor. However, if desired, it is possible for a connection of a plurality of lamps in parallel to be monitored using a single visual monitor circuit.

While particular embodiments of the invention have been shown and described, it will be understood that the invention is not limited thereto, as many modifications may be made and will become apparent to those skilled in art. For example, various ballast and starter connections may be different from that shown in FIG. 2. Notwithstanding how such components may be connected to each other, however, if the connections of the indicator lights are in accordance with that shown in FIG. 2, then such a circuit would be in accordance with the present invention. It may also be noted that even though the operation of diode 28 operates in connection with a voltage divider, such voltage divider is not necessary to its operation.

What is claimed is:

1. In combination with a light fixture including a lamp, a ballast connected to the lamp and a starter connected to the lamp for providing voltage pulses thereto, a visual monitor including an indicator light circuit connected to the starter having a storage capacitor, a diode connected to said capacitor and conductive at a predetermined voltage, and an indicator light connected to said capacitor, wherein when the lamp is not lit, a properly operating starter producing pulses of short duration of predetermined amplitude causes conduction of said diode and storage on said capacitor, a plurality of pulses causing capacitor discharge through said indicator to cause a periodic blinking thereof, the absence of periodic light blinking indicating a starter failure.

2. A visual monitor in accordance with claim 1, and including a voltage divider connected to said starter and said indicator light circuit for establishing the predetermined amplitude level of the voltage for causing conduction of said diode.

3. A visual monitor in accordance with claim 1, wherein said threshold level for conduction of said diode is greater than the peak voltage level of the output from said ballast.

4. Visual monitor for a light fixture including a lamp and a ballast and a starter for providing voltage pulses, each connected to the lamp, said monitor comprising:

a first indicator light circuit connected in parallel with the lamp and including a first indicator light, p1 a second indicator light circuit connected to the starter and including a storage capacitor, a diode connected to said capacitor and conductive at a predetermined voltage, and a second indicator light connected to said capacitor, whereby an open lamp increases current through said first indicator light to cause by its ignition a lamp failure indication, whereby when the lamp is not lit, a properly operating starter producing pulses of short duration of predetermined amplitude causes conduction of said diode and storage on said capacitor, a plurality of pulses causing capacitor discharge through said second indicator to cause a periodic blinking thereof, the absence of periodic light blinking indicates a starter failure, and whereby the absence of the ignition of said first indicator light with the absence of the lamp being lit is an indication of ballast failure.

5. A visual monitor in accordance with claim 4, and including a voltage divider connected to said starter and said second indicator light circuit for establishing the predetermined amplitude level of the voltage for causing conduction of said diode.

6. A visual monitor in accordance with claim 4, wherein said threshold level for conduction of said diode is greater than the peak voltage level of the output from said ballast.

* * * * *